United States Patent [19]

Guntly et al.

[11] Patent Number: 4,998,580

[45] Date of Patent: Mar. 12, 1991

[54] CONDENSER WITH SMALL HYDRAULIC DIAMETER FLOW PATH

[75] Inventors: Leon A. Guntly; Norman F. Costello, both of Racine, Wis.

[73] Assignee: Modine Manufacturing Company, Racine, Wis.

[21] Appl. No.: 141,628

[22] Filed: Jan. 7, 1988

Related U.S. Application Data

[63] Continuation-in-part of Ser. No. 902,697, Sep. 5, 1986, abandoned, which is a continuation-in-part of Ser. No. 783,087, Oct. 2, 1985, abandoned.

[51] Int. Cl.[5] ..... F28F 13/18; F28F 19/02

[52] U.S. Cl. ..... 165/133; 165/152; 165/173; 165/179

[58] Field of Search ..... 165/133, 152, 179, 173; 62/515, 514 R, 507, 428; 228/223, 224

[56] References Cited

U.S. PATENT DOCUMENTS

| | | | |
|---|---|---|---|
| 2,136,641 | 11/1938 | Smith . | |
| 2,819,731 | 1/1958 | Louthan . | |
| 3,204,693 | 9/1965 | Kuhn . | |
| 3,239,922 | 3/1966 | Hansson . | |
| 3,274,797 | 9/1966 | Kritzer . | |
| 3,689,972 | 9/1972 | Mosier et al. | 165/175 X |
| 3,750,709 | 8/1973 | French . | |
| 3,920,069 | 11/1975 | Mosier . | |
| 3,922,880 | 12/1975 | Morris . | |
| 3,951,328 | 4/1976 | Wallace et al. | 228/207 |
| 3,994,337 | 11/1976 | Asselman et al. | 62/317 X |
| 4,089,324 | 5/1978 | Tjaden | 165/133 X |
| 4,392,362 | 7/1983 | Little . | |
| 4,723,597 | 2/1988 | Sonoda | 165/133 |

FOREIGN PATENT DOCUMENTS

| | | | |
|---|---|---|---|
| 3011497 | 10/1980 | Fed. Rep. of Germany | 165/133 |
| 6059190 | 5/1981 | Japan | 165/133 |
| 0142493 | 9/1982 | Japan | 165/133 |
| 0198992 | 12/1982 | Japan | 165/152 |
| 58-27037 | 7/1983 | Japan . | |
| 0221390 | 12/1983 | Japan | 165/179 |
| 556766 | 10/1943 | United Kingdom . | |
| 2059562 | 4/1981 | United Kingdom | 165/179 |
| 1601954 | 11/1981 | United Kingdom | 165/179 |

OTHER PUBLICATIONS

"Compact Heat Exchangers", McGraw-Hill, Copyright 1955 and 1964, pp. 1-9.

*Primary Examiner*—Carl D. Price

*Attorney, Agent, or Firm*—Wood, Phillips, Mason, Recktenwald & VanSanten

[57] ABSTRACT

An improved condenser for use in air conditioning or refrigeration systems. A pair of spaced headers have a plurality of tubes extending in hydraulic parallel between them and each tube defines a plurality of hydraulically parallel, fluid flow paths between the headers. Each of the fluid flow paths has a hydraulic diameter in the range of about 0.015 to about 0.04 inches. Preferably, each fluid flow path has an elongated crevice extending along its length to accumulate condensate and to assist in minimizing film thickness on heat exchange surfaces through the action of surface tension. Heat exchange surfaces may also be provided with microcracks or channels to enhance heat transfer.

10 Claims, 6 Drawing Sheets

FIG. 1
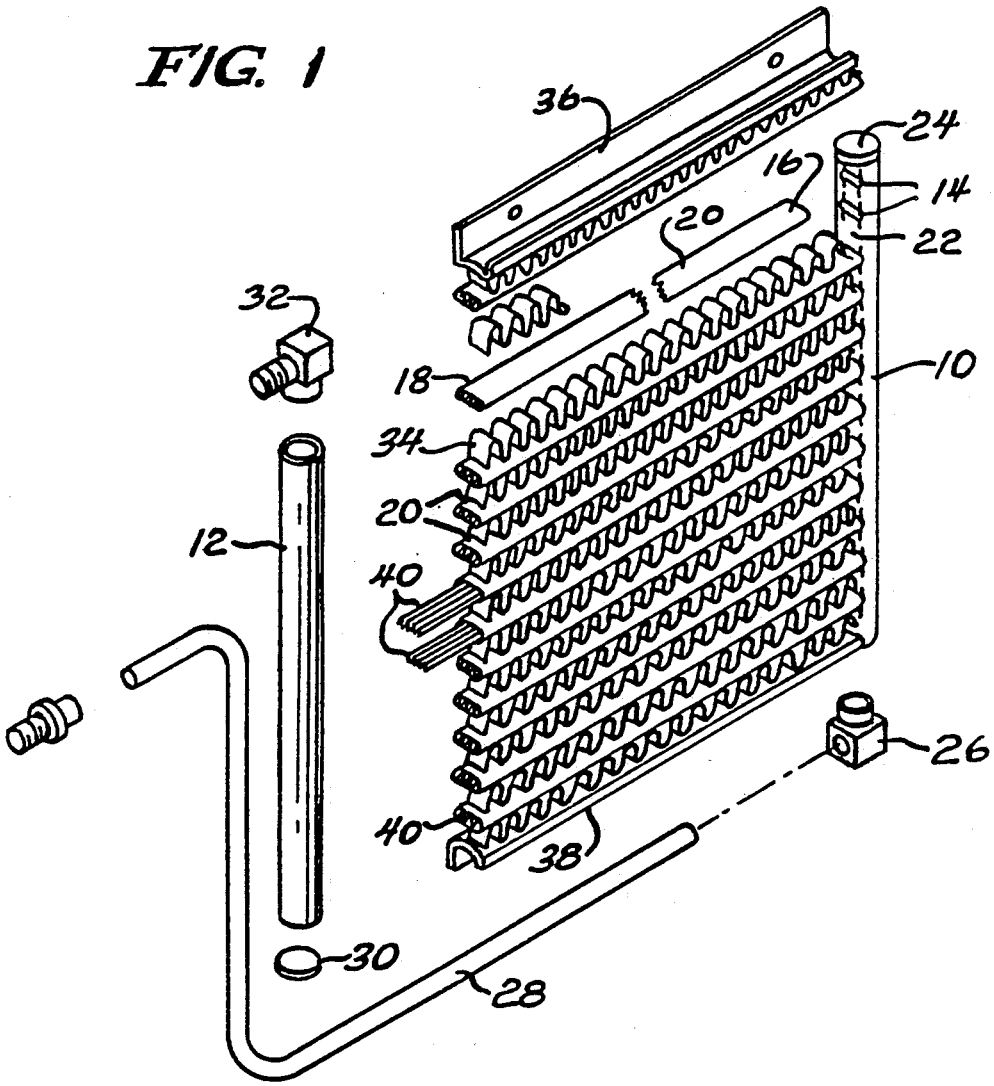
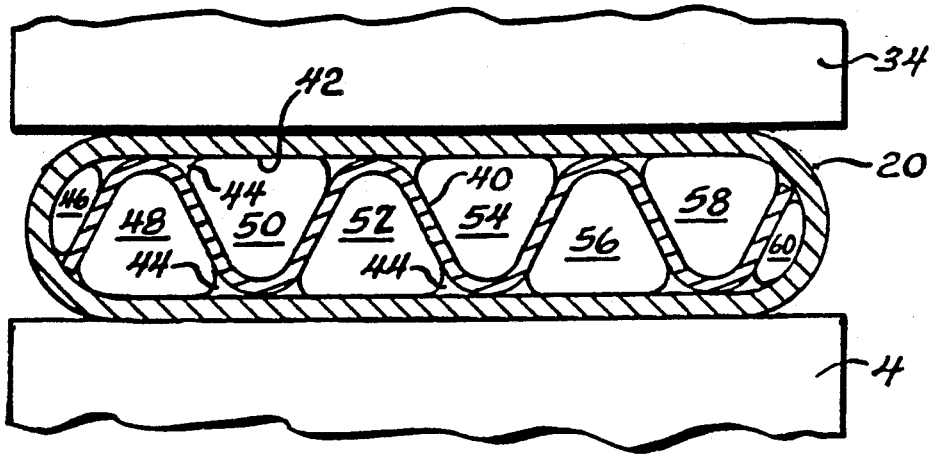
FIG. 2

FIG. 3
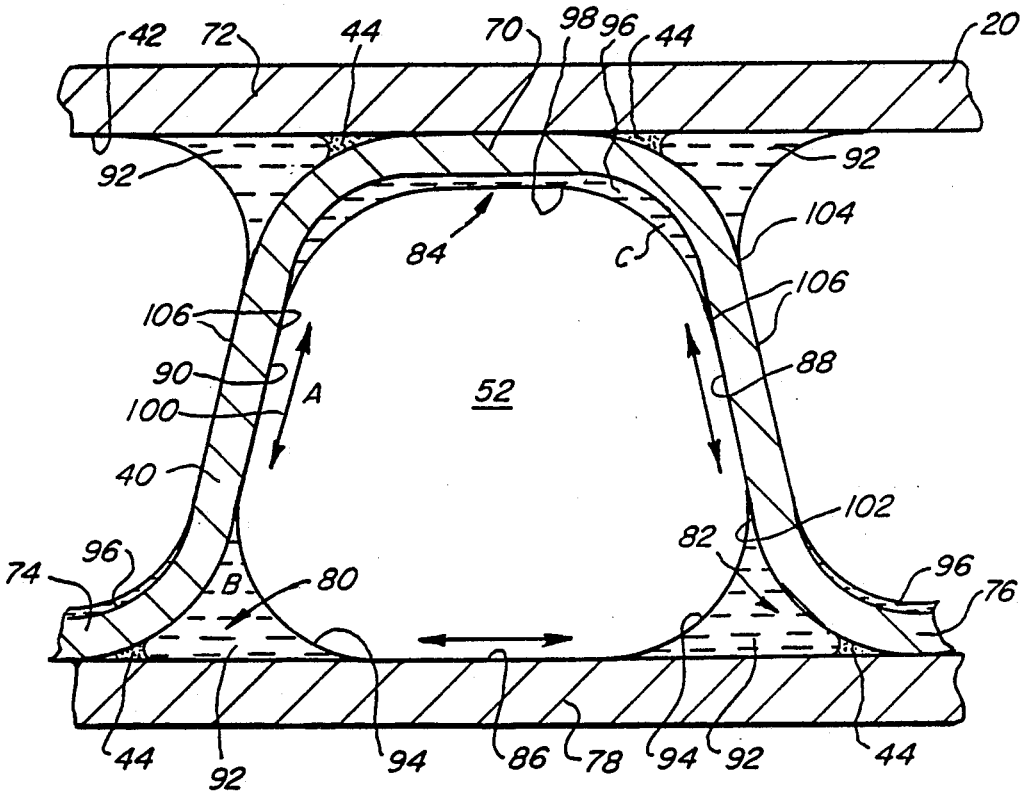
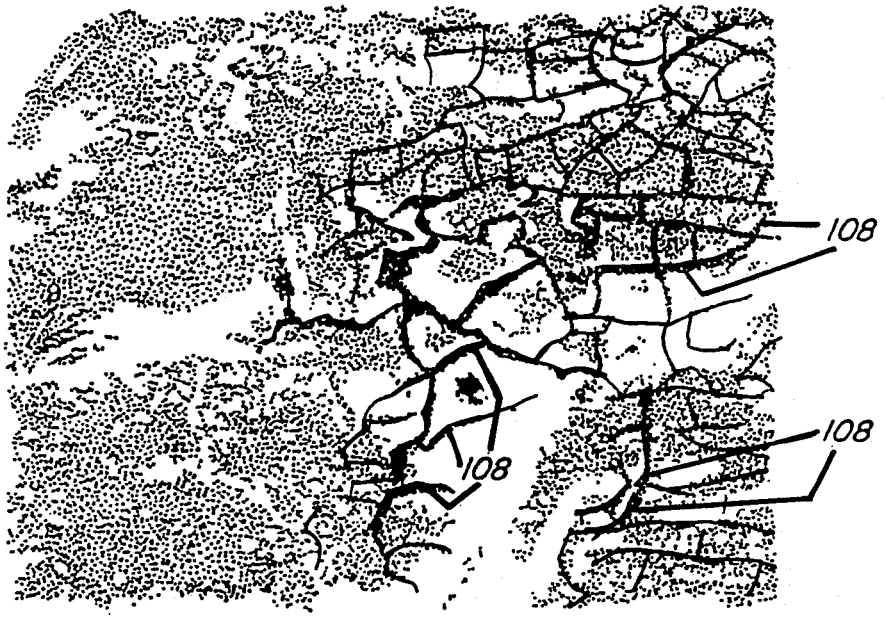
FIG. 4

CONDENSER WITH SMALL HYDRAULIC DIAMETER FLOW PATH

CROSS-REFERENCE

This application is a continuation-in-part of commonly assigned copending application Ser. No. 902,697, filed Sept. 5, 1986 and now abandoned, which, in turn, is a continuation-in-part of commonly assigned copending application Ser. No. 783,087, filed Oct. 2, 1985 and now abandoned, both entitled "Condenser With Small Hydraulic Diameter Flow Path".

FIELD OF THE INVENTION

This invention relates to condensers, and more particularly, to condensers such as are used in air conditioning or refrigeration systems for condensing a refrigerant.

BACKGROUND OF THE INVENTION

Many condensers employed in air conditioning or refrigeration systems at the present time utilize one or more serpentine conduits on the vapor side. In order to prevent the existence of an overly high pressure differential from the vapor inlet to the outlet, which would necessarily increase system energy requirements, the flow passages within such tubes are of relatively large size to avoid high resistance to the flow of vapor and/or condensate.

This, in turn, means that the air side of the tubes will be relatively large in size. The relatively large size of the tubes on the air side results in a relatively large portion of the frontal are of the air side being blocked by the tubes and less area available in which air side fins may be disposed to enhance heat transfer.

As a consequence, to maintain a desired rate of heat transfer, the air side pressure drop will become undesirably large, and a commensurately undesirably large system energy requirement in moving the necessary volume of air through the air side of the condenser will result.

The present invention is directed to overcoming one or more of the above problems.

SUMMARY OF THE INVENTION

It is the principal object of the invention to provide a new and improved condenser for use in air conditioning or refrigeration systems. More specifically, it is an object of the invention to provide such a condenser wherein the condenser has a lesser frontal area blocked by tubes on the air side allowing an increase in the air side heat exchange surface area without increasing air side pressure drop and without increasing vapor and/or condensate side pressure drop.

An exemplary embodiment of one facet of the invention achieves the foregoing objects in a condenser comprising a pair of spaced headers, the headers having a vapor inlet and a condensate outlet. A condenser tube extends between the headers and is in fluid communication with each. The tube defines a plurality of hydraulically parallel substantially discrete fluid flow paths between the headers and each of the fluid flow paths has a hydraulic diameter in the range of about 0.015 to 0.040 inches.

In a preferred embodiment, there are a plurality of such tubes extending between the headers in hydraulic parallel with each other in sufficient number as to avoid high resistance to condensate and/or vapor flow.

According to another facet of the invention, it is contemplated that the plurality of flow paths in each tube be noncircular in cross section and formed to have at least one crevice along the length thereof such that surface tension of the refrigerant will cause condensed refrigerant to accumulate in such crevice thereby reducing the thickness of the film of condensed refrigerant elsewhere about the flow path. The reduced film thickness thus enhances heat transfer from vapor to the material defining the flow paths at areas other than at the crevice to improve performance.

In a highly preferred embodiment, flow paths having at least one crevice as mentioned in the preceding paragraph are provided by utilizing an undulating spacer within a flattened tube. Where each crest of the spacer contacts the tube, two of the aforementioned crevices are formed.

Fins may be disposed on the exterior of the condenser tube and extend between the exteriors of adjacent ones of the condenser tubes.

The invention contemplates that the headers be defined by generally cylindrical tubes having facing openings, such as slots, for receiving respective ends of the condenser tubes.

According to still another facet of the invention, the interior surfaces of the flow paths have a thin, uneven coating of a ceramic material having microscopic cracks or channels therein. Through a mechanism not fully understood, heat transfer is improved as a result. It is believed that the cracks or channels tend to break up the typically found laminar boundary layer and may, by capillary action, further assist in aglomerating condensate to minimize film thickness.

In a highly preferred embodiment, the flow paths may be defined by spacers disposed within tubes and brazed in place and the ceramic is residual, noncorrosive, brazing flux.

Other objects and advantages will become apparent from the following specification taken in connection with the accompanying drawings.

DESCRIPTION OF THE DRAWINGS

FIG. 1 is an exploded, perspective view of a condenser made according to the invention;

FIG. 2 is a fragmentary, enlarged, somewhat schematic cross-sectional view of a condenser tube that may be employed in the invention;

FIG. 3 is an enlarged, fragmentary cross sectional view of a flow passage as it is believed to appear during condensation;

FIG. 4 is a halftone photomicrograph illustrating the internal surface of a flow passage;

DESCRIPTION OF THE PREFERRED EMBODIMENT

Figure 5:
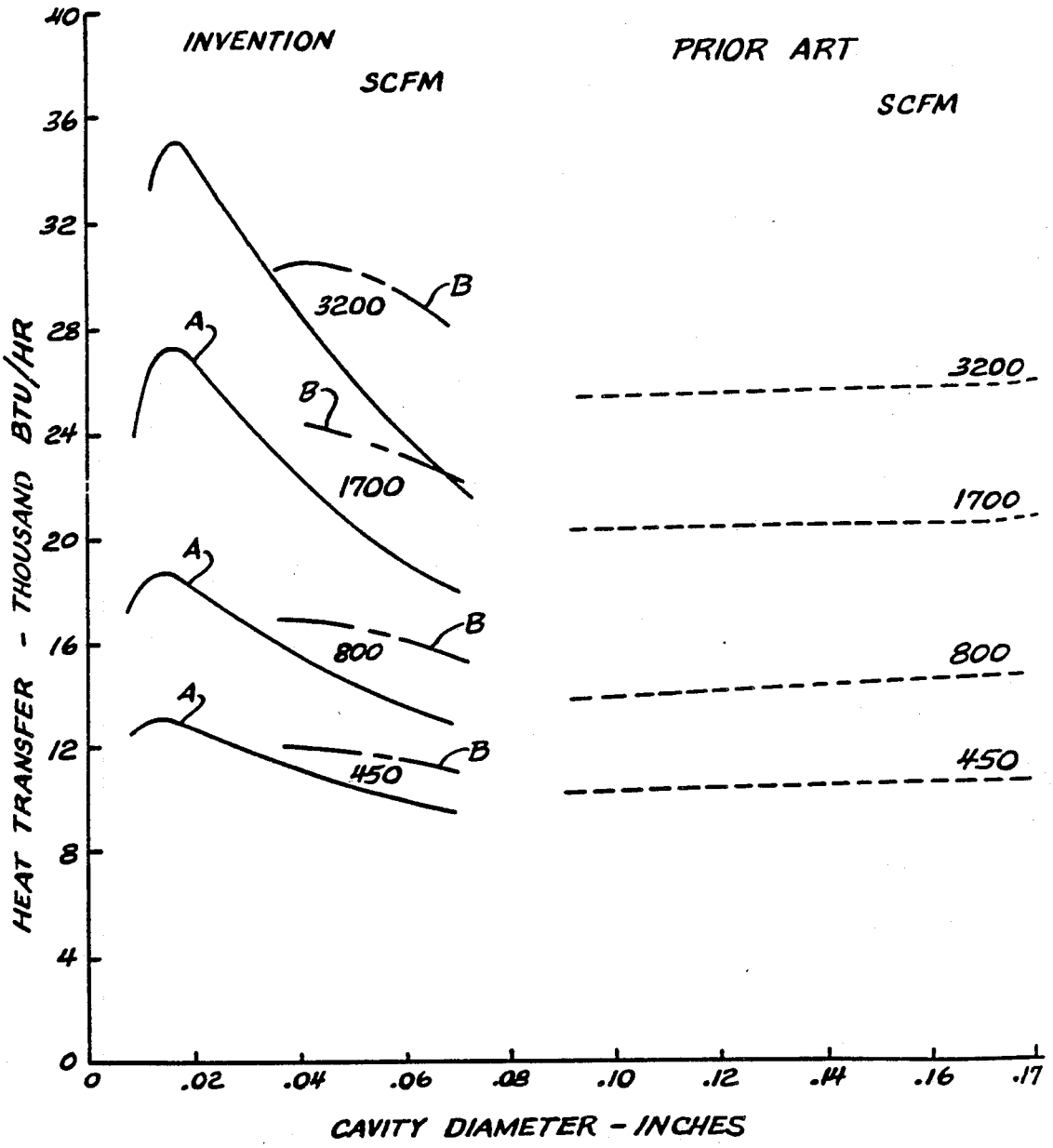
FIG. 5 is a graph of the predicted performance of condensers with the same face area, some made in a prior art design and others made according to the invention, plotting heat transfer against cavity (hydraulic) diameter.

An exemplary embodiment of a condenser made according to the invention is illustrated in FIG. 1 and is seen to include opposed, spaced, generally parallel headers 10 and 12. According to the invention, the headers 10 and 12 are preferably made up from generally cylindrical tubing. On their facing sides, they are provided with a series of generally parallel slots or openings 14 for receipt of corresponding ends 16 and 18 of flattened or oval condenser tubes 20.

Preferably, between the slots 14, in the area shown at 22, each of the headers 10 and 12 is provided with a somewhat spherical dome to improve resistance to pressure as explained more fully in the commonly assigned, copending application of Saperstein et al, entitled "Heat Exchanger" application Ser. No. 722,653, filed Apr. 12, 1985, now U.S. Pat. No. 4,615,385, the details of which are herein incorporated by reference.

The header 10 has one end closed by a cap 24 brazed or welded thereto. Brazed or welded to the opposite end is a fitting 26 to which a tube 28 may be connected.

The lower end of the header 12 is closed by a welded or brazed cap 30 similar to the cap 24 while its upper end is provided with a welded or brazed in place fitting 32. Depending upon the orientation of the condenser, one of the fittings 26 and 32 serves as a vapor inlet while the other serves as a condensate outlet. For the orientations shown in FIG. 1, the fitting 26 will serve as a condensate outlet. In some cases, the inlet and outlet may be in the same header and separated by a suitable baffle or plug.

A plurality of the tubes 20 extend between the headers 10 and 12 and are in fluid communication therewith. The tubes 20 are geometrically in parallel with each other and hydraulically in parallel as well. Disposed between adjacent ones of the tubes 20 are serpentine fins 34 which are highly preferred although plate fins could be used if desired. Upper and lower channels 36 and 38 extend between and are bonded by any suitable means to the headers 10 and 12 to provide rigidity to the system.

As can be seen in FIG. 1, each of the tubes 20 is a flattened tube and within its interior includes an undulating or sinusoidally shaped spacer 40.

In cross section, the spacer 40 appears generally as shown in FIGS. 2 and 3 and it will be seen that alternating crests are in contact along their entire length with the interior wall 42 of the tube 20 and bonded thereto by fillets 44 of solder or braze metal, preferably the latter as will be seen. (In practice, the spacers 40 may be somewhat flattened, particularly at the crests, as a result of the manufacturing process.) As a consequence, a plurality of substantially discrete hydraulically parallel fluid flow paths 46, 48, 50, 52, 54, 56, 58 and 60 are provided within each of the tubes 20 with the flow paths 48, 50, 52, 54, 56 and 58 being of nominally triangular cross section. That is to say, there is virtually no fluid communication from one of such flow paths to the adjacent flow paths on each side. This effectively means that each of the walls separating adjacent fluid flow paths 46, 48, 50, 52, 54, 56, 58 and 60 are bonded to both of sides of the flattened tube 20 along their entire length. As a consequence, there is no gap that would be filled by fluid with a lesser thermal conductivity. As a result, heat transfer from the fluid via the walls separating the various fluid flow paths identified previously to the exterior of the tube is maximized.

A second advantage resides in the fact that condensers are employed on the outlet side of a compressor and therefore are normally subjected to extremely high pressure during operation. Conventionally, this high pressure will be applied to the interior of the tubes 20. Where so-called "plate" fins are utilized in lieu of the serpentine fins 34 illustrated in the drawings, the same tend to confine the tubes 20 and support them against the internal pressure employed in a condenser application. Conversely, serpentine fins such as those shown at 34 are incapable of supporting the tubes 20 against substantial internal pressure. According to the invention, however, the desired support in a serpentine fin heat exchanger is accomplished by the fact that the spacer 40 and the crests thereof are bonded along the entire length of the interior wall 42 of each tube 20. This bond results in various parts of the spacer 40 being placed in tension when the tube 20 is pressurized to absorb the force resulting from internal pressure within the tube 20 tending to expand the tube 20. Thus the tubes have the ability to withstand high pressures of several hundreds of pounds per square inch because of the elongated uninterrupted spacer to tube bonds.

One means by which the tubes 20 with accompanying spacers 40 may be formed is disclosed in the commonly assigned application of Saperstein, entitled "Tube and Spacer Construction For Use In Heat Exchangers", Ser. No. 740,000, filed May 31, 1985 now abandoned, the details of which are herein incorporated by reference. A highly preferred means by which the tubes 20 with accompanying spacers 40 may be formed is disclosed in the commonly assigned application of Saperstein et al, entitled "Method of Making a Heat Exchanger", Ser. No. 887,223, filed Jul. 21, 1986, now U.S. Pat. No. 4,688,311, the details of which are also herein incorporated by reference.

According to the invention, each of the flow paths 48, 50, 52, 54, 56 and 58, and to the extent possible depending upon the shape of the spacer 40, the flow paths 46 and 60 as well, are capillary flow paths and have hydraulic diameters in the range of about 0.015 to 0.040 inches. Given current assembly techniques known in the art, a hydraulic diameter of approximately 0.025 inches optimizes ultimate heat transfer efficiency and ease of construction. Hydraulic diameter is as conventionally defined, namely, the cross-sectional area of each of the flow paths multiplied by four and in turn divided by the wetted perimeter of the corresponding flow path.

The values of hydraulic diameter given are for condensers in R-12 systems. Somewhat different values might be expected in systems using different refrigerants.

Within that range, it is desirable to make the tube dimension across the direction of air flow through the core as small as possible. This in turn will provide more frontal area in which fins, such as the fins 34, may be disposed in the core without adversely increasing air side pressure drop to obtain a better rate of heat transfer. In some instances, by minimizing tube width, one or more additional rows of the tubes can be included.

In this connection, the preferred embodiment contemplates that tubes with separate spacers such as illustrated in FIG. 2 be employed as opposed to extruded tubes having passages of the requisite hydraulic diameter. Current extrusion techniques that are economically feasible at the present for large scale manufacture of condensers generally result in a tube wall thickness that is greater than that required to support a given pressure using a tube and spacer as disclosed herein. As a consequence, the overall tube width of such extruded tubes is somewhat greater for a given hydraulic diameter than a tube and spacer combination, which is undesirable for the reasons stated immediately preceding. Nonetheless, the invention contemplates the use of extruded tubes having passages with a hydraulic diameter within the stated range.

It is also desirable that the ratio of the outside tube periphery to the wetted periphery within the tube be made as small as possible so long as the flow path does not become sufficiently small that the refrigerant cannot readily pass therethrough. This will lessen the resistance to heat transfer on the vapor and/or condensate side.

In addition to the utilization of a relatively small hydraulic diameter for the flow paths as mentioned previously, as another facet of the invention, it is contemplated that each of the flow paths have at least one crevice preferably extending along the entire length of the flow path, but at least along a substantial part of that portion of the flow path that is exposed to vapor. As is apparent from FIGS. 2 and 3, the use of the undulating spacer 40 provides two to three such crevices for each flow path. Looking, for example, at the flow path 52, the spacer 40 has one crest 70 bonded to an upper side 72 of the tube 20 as indicated by the presence of the fillets 44 and adjacent crests 74 and 76 bonded to the lower side 78 of the tube 20. One such crevice is generally designated 80 and is located at the juncture of the crest 74 and the tube side 78. A second such crevice is generally designated 82 and is located at the juncture of the crest 76 and the tube side 78. It will be seen that both the crevices 80 and 82 are quite well defined as crevices notwithstanding the fact that they are partially filled by respective fillets 44 of braze material.

A less well defined crevice (semi crevice?) is generally designated 84 and is in fact defined by the concave curved part of the insert crest 70.

The crevices 80 and 82 are separated by a relatively flat area 86 and similar relatively flat areas 88 and 90 respectively separate crevices 82 and 84 and the crevices 80 and 84. These crevices unexpectedly increase heat transfer from vapor flowing in the flow passages to both the spacer 40 and the tube 20. The mechanism by which improved heat transfer is believed to occur is as follows. It is known that the equilibrium vapor pressure above a liquid surface is dependent upon the curvature of the surface. As a result, the local liquid pressure on a concave liquid surface is less than the local vapor pressure. Therefore, a pressure gradient will exist across the interface of the vapor and the liquid. The magnitude of the pressure differential will depend upon the curvature of the interface.

Applying the foregoing to FIG. 3, it will be considered that the surface tension of the condensing refrigerant within a flow passage such as the flow passage 52 will result in bodies 92 of condensed refrigerant in the crevices 80 and 82 having generally similar concave surfaces 94. In addition, a lesser body of condensed refrigerant 96 will accumulate in the semi crevice 84 and will have a somewhat larger radius of curvature for its surface 98. At the same time, at the relatively flat areas 86, 88 and 90, there will be a very thin film of condensed refrigerant having essentially no curved surface whatsoever. As a consequence, the liquid pressure at a generally central point A on the flat surface 90, for example, will be approximately equal to the vapor pressure within the flow path center and greater than the pressure at point B in the condensate body 92 or point C in the condensate body 96. As a result the film will flow bidirectionally as indicated by an arrow 100 to the areas of lesser pressure, namely, the body 92 in the crevice 80 and the body 96. Similar action will occur in the flat areas 86 and 88 for the same reasons.

What this all means is that the film of condensed refrigerant in the areas 86, 88 and 90 will be thinned as the condensate flows to and collects in the crevices. This thinned film provides less resistance to heat transfer from the vapor to the tube 20 or spacer 40 than the film in a conventionally shaped flow passage. As a consequence, the local heat transfer rate is dramatically increased over a circular passage with the same hydraulic diameter because of the very high heat transfer rate at the flat areas 86, 88 and 90.

As the two-phase mixture flows down a flow path, the crevices increasingly fill and the collecting streams of condensate eventually merge, leaving a core of vapor. As flow continues, the vapor core will continue to shrink until finally surface tension causes the liquid to collapse upon itself forming intermittent liquid slugs, separated by small elongated vapor bubbles which will be pushed down the passage by the liquid slugs and which will rapidly collapse as condensation continues to occur. The small hydraulic diameters that are employed allow the various flow paths to completely fill with condensed refrigerant due to capillary forces. Unexpectedly this renders operation of the condenser independent of gravity, which is to say that it will operate successfully in virtually any attitude. In summary then, the small crevices create significant surface tension forces which otherwise would not exist and which promote thinning of the vapor film at other areas on the interior of the flow passages to enhance heat transfer.

According to still another facet of the invention, the interior surface 42 of the tube 20 and the surfaces 102 and 104 of the spacer 40 are provided with microcracks or channels 108. The width of these channels is on the order of 0.001 mm and they are illustrated in FIG. 4 which is a photomicrograph of the surfaces, magnified 1,000 times.

As shown somewhat schematically in FIG. 3, the surfaces 102 and 104 of the insert 40 carry a thin coating 106 in which microcracks 108 are located. The coating 106 may be of ceramic material that strongly adheres to the surfaces 42, 102 and 104 and which tends to crack or craze through its thickness to form the microcracks or channels 108 upon cooling from an elevated temperature.

Now as mentioned previously, it is preferable that the insert 40 be brazed to the interior surface 42 of the tube 20 and also as mentioned previously, one highly preferred method of forming the tubes 20 with the inserts 40 is disclosed in the commonly assigned application of Saperstein et al, Ser. No. 887,223. That method of forming the tubes involves brazing processes licensed under the trademark NOCOLOK. These processes utilize noncorrosive fluxes which frequently, but not always, are both nonhydroscopic and nonhydrated. Typical fluxes of this sort are described in U.S. Pat. No.

3,951,328 issued Apr. 20, 1976 to Wallace et al, the details of which are herein incorporated by reference. Additionally, both the hydrated and nonhydrated fluxes described in U.S. Pat. No. 4,579,605 issued Apr. 1, 1986 to Kawase et al, the details of which are herein incorporated by reference, may be used. Preferably, the fluxes are contained in a water suspension which constitutes 25% by weight and the fluxes applied to the tube 20 and the spacer 40, when made of aluminum, by dipping, spraying or by electrostatic deposition.

In any event, after brazing following conventional flux application to the insert 40, the fluxes leave a residue which constitutes the coating 106 with the microcracks 108 shown in FIG. 4 therein.

The presence of the flux residue also unexpectedly increases the heat transfer rate. It is believed that this increase results from the following mechanisms. The microcracks or channels 108 form indentations on the surfaces 42, 102 and 104 which can disturb or break up the laminar structure of the condensate film thereon causing turbulence. This effect is considered to be most important at areas where the film is very thin, that is, in the relatively flat areas 86, 88 and 90. As is known increased turbulence will increase heat transfer.

In addition, the microcracks or channels 108 may possibly cause capillary pumping of condensate from the flat areas 86, 88 and 90 to the crevices 80, 82 and 84 which further helps to thin the condensate film in those areas. This capillary pumping is also believed to be driven by the pressure differential mentioned previously.

Also, the microcracks 108, when not filled with condensate, may possibly cause capillary condensation from the vapor. Capillary condensation is the common mechanism by which desiccants absorb vapors.

A number of advantages of the invention will be apparent from the data illustrated in FIGS. 5–8 inclusive and from the following discussion. FIG. 5, for example, on the right-hand side, plots the heat transfer rate against the cavity or hydraulic diameter in inches at air flows varying from 450 to 3200 standard cubic feet per minute for production condenser cores made by the assignee of the instant application.

To the left of such data are computer generated curves based on a heat transfer model for a core made according to the present invention, the model constructed using empirically obtained data. Various points on the curves have been confirmed by actual tests. The curves designated "A" represent heat transfer at the stated air flows for a core such as shown in FIG. 1 having a frontal area of two square feet utilizing tubes approximately 24 inches long and having a 0.015 inch tube wall thickness, a 0.532 tube major dimension, 110° F. inlet air, 180° F. inlet temperature and 235 psig pressure for R-12 and assuming 2° F. of subcooling of the exiting refrigerant after condensation. The core was provided with 18 fins per inch between tubes and the fins were 0.625 inches by 0.540 inches by 0.006 inches.

The curves designated "B" show the same relationship for an otherwise identical core but wherein the length of the flow path in each tube was doubled i.e., the number of tubes was halved and tube length was doubled. As can be appreciated from FIG. 5, heat transfer is advantageously and substantially increased in the range of hydraulic diameters of about 0.015 inches to about 0.040 inches through the use of the invention with some variance depending upon air flow.

Figure 6:
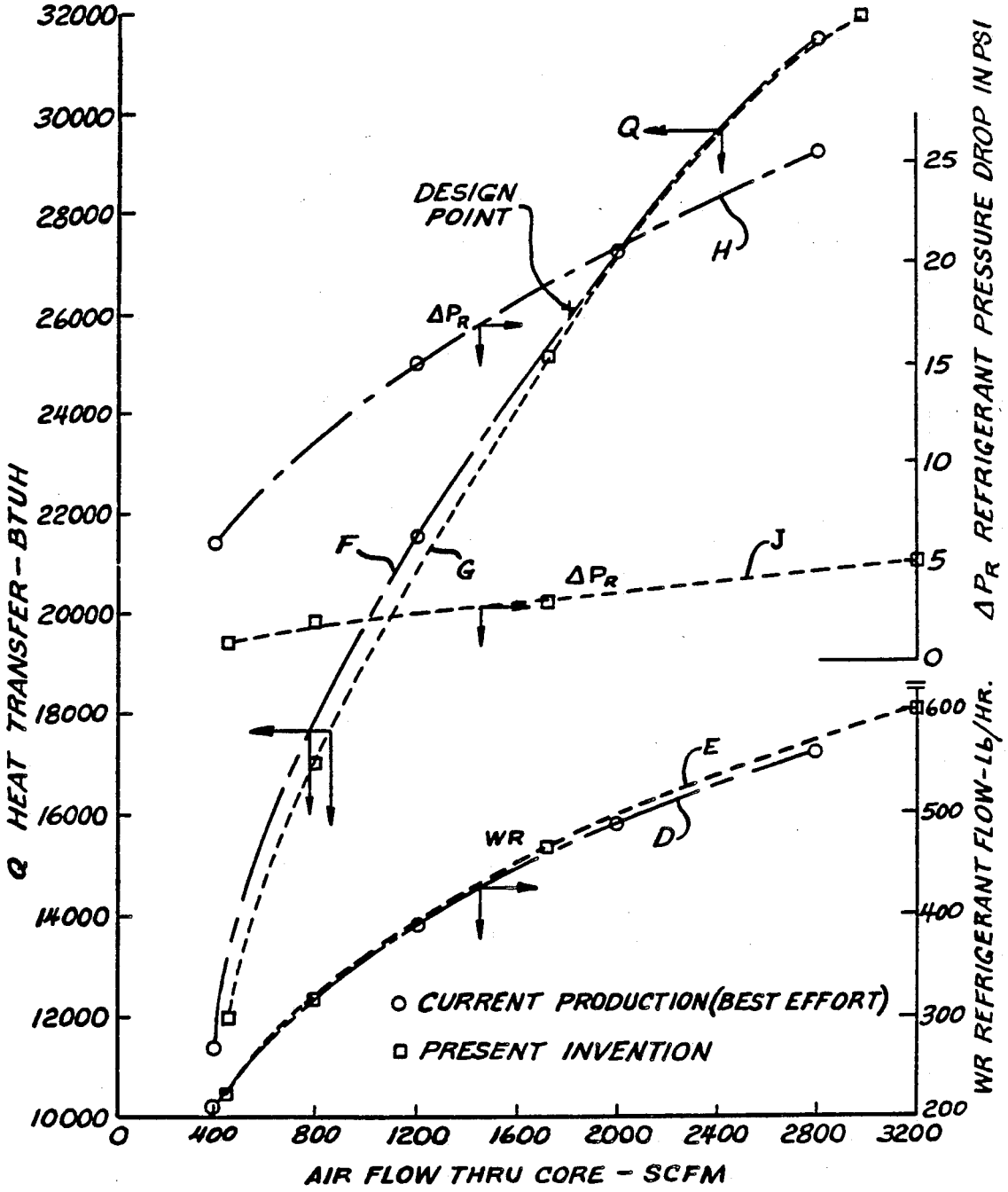
FIG. 6 is a graph comparing the present invention with the prior art construction showing air flow through each versus (a) the rate of heat transfer, (b) the refrigerant flow rate, and (c) the refrigerant pressure drop.

Turning now to FIG. 6, actual test data for a core made according to the invention and having the dimensions stated in Table 1 below is compared against actual test data for a condenser core designated by the assignee of the present application as "1E2803". The data for the conventional core is likewise listed in Table 1 below.

Both the core made according to the invention and the conventional core have the same design point which is, as shown in FIG. 6, a heat transfer rate of 26,000 BTU per hour at an air flow of 1800 standard cubic feet per minute. The actual observed equivalence of the two cores occurred at 28,000 BTU per hour and 2,000 standard cubic feet per minute; and those parameters may be utilized for comparative purposes.

Viewing first the curves "D" and "E" for the prior art condenser and the subject invention respectively it will be appreciated that refrigerant flow for either is comparable over a wide range of air flow values. For this test, and those illustrated elsewhere in FIGS. 6–8, R-12 was applied to the condenser inlet at 235 psig at 180° F. The exiting refrigerant was subcooled 2° F. Inlet air temperature to the condenser was 110° F.

The greater refrigerant side pressure drop across a conventional core than that across a core made according to the invention suggests a greater expenditure of energy by the compressor in the conventional system than in the one made according to the subject invention as well.

Curves "F" and "G", again for the prior art condenser and the condenser of the subject invention, respectively, show comparable heat transfer rates over the same range of air flows.

Curves "H" and "J" respectively for the conventional condenser and the condenser of the subject invention illustrate a considerable difference in the pressure drop of the refrigerant across the condenser. This demonstrates one advantage of the invention. Because of the lesser pressure drop across the condenser when made according to the invention, the average temperature of the refrigerant, whether in vapor form or in the form of condensate will be higher than with the conventional condenser. As a consequence, for the same inlet air temperature, a greater temperature differential will exist across the walls of the tubes which, according to Fourier's law, will enhance the rate of heat transfer.

There will also be a lesser air side pressure drop in a core made according to the invention than with the conventional core. This is due to two factors, namely, the lesser depth of the core and the greater free flow area not blocked by tubes; and such in turn will save on the fan energy required to direct the desired air flow rate through the core. Yet, as shown by the curves "F" and "G" the heat transfer rate remains essentially the same.

It has also been determined that a core made according to the invention, when compared with the conventional core, holds less refrigerant. Thus, the core of the invention reduces the system requirement for refrigerant. Typically a 25% reduction in the refrigerant quantity is achievable.

This in turn renders a system using a condenser made according to the invention more environmentally acceptable since less chlorofluorocarbon refrigerant is required. Similarly, there is lesser space required for installation of the inventive core because of its lesser depth.

Figure 7:
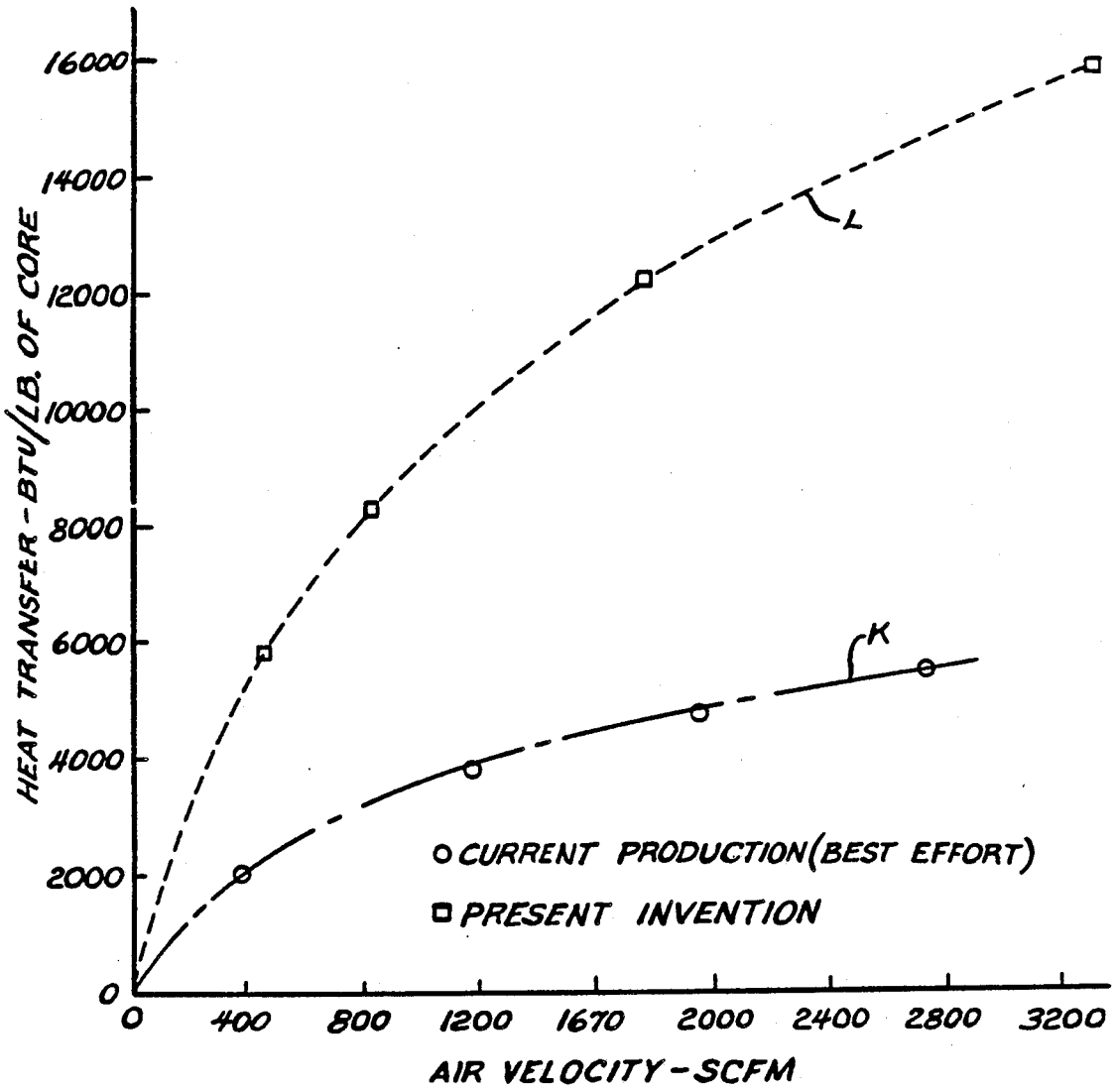
FIG. 7 is a further graph comparing the prior art construction with a condenser made according to the invention on the basis of air velocity versus the heat transfer per pound of material employed in making up the core of each.

As can be seen from the table, and in consideration with the data shown in FIG. 6, it will be appreciated that a core made according to the invention can be made of considerably lesser weight than a conventional core. Thus, FIG. 7 compares, at various air velocities, the heat transfer rate per pound of core of the conventional condenser (curve "K") versus heat transfer per pound of core of a condenser made according to the invention (curve "L"). Thus, FIG. 7 demonstrates a considerable weight savings in a system may be obtained without sacrificing heat transferability by using the core of the present invention.

TABLE 1

CONDENSER CORE PHYSICAL PROPERTIES FOR FIGS. 5 AND 6

| CORE PROPERTIES | CURRENT PRODUCTION 1E2803 | PRESENT INVENTION |
|---|---|---|
| Depth (in.) | .938 | .540 |
| Heights (in.) | 12.276 | 12.00 |
| Length (in.) | 24.13 | 23.259 |
| Face Area (ft.$^2$) | 2.057 | 1.938 |
| Weight (lbs) | 5.682 | 2.057 |
| Ratio outside surface inside surface | 4.478 | 5.391 |
| FIN PROPERTIES | | |
| FPI | 12 | 18 |
| Fin Rows | 13 | 21 |
| Fin Thickness (in.) | .008 | .004 |
| Fin Height (in.) | .7502 | .5018 |
| Free Flow Area (ft$^2$) | 1.444 | 1.554 |
| Surface Area (ft$^2$) | 37.110 | 33.389 |
| Hydraulic Diameter (in.) | .1304 | .0910 |
| Fin Weight (lbs.) | 2.163 | .993 |
| TUBE PROPERTIES | | |
| No. Circuits | 2 | 20 |
| Tube Rows | 14 | 20 |
| Tube Thickness (in.) | .187 | .075 |
| Tube Wall (in.) | .027 | .015 |
| Tube Length (ft.) | 15.168 | 2.047 |
| Free Flow Area (in.$^2$) | .1556 | .3200 |
| Hydraulic Diameter (in.) | .07871 | .0302 |
| Outside Tube Surface (ft$^2$) | 4.431 | 3.494 |
| Inside Tube Surface (ft$^2$) | 9.276 | 6.842 |
| Tube Weight (lbs.) | 3.519 | 1.064 |

Figure 8:
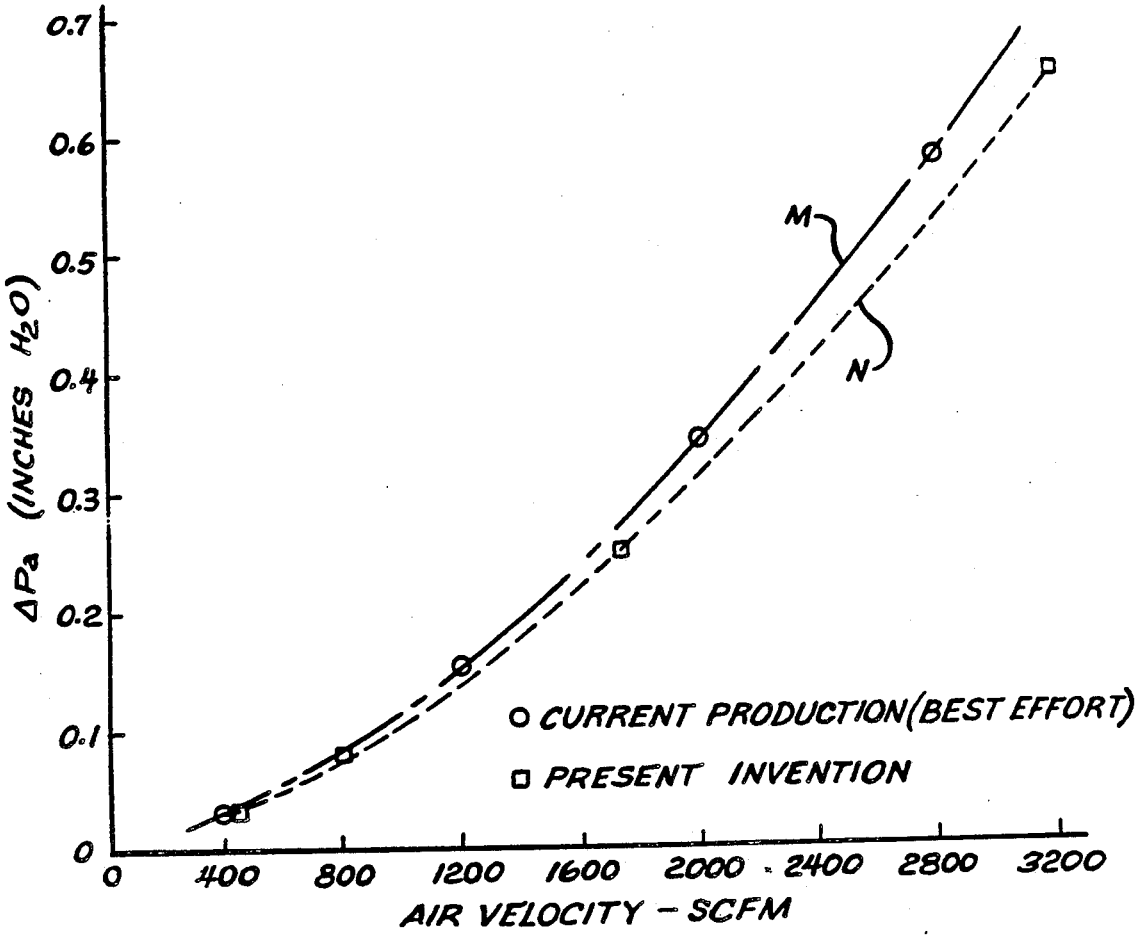
FIG. 8 is a further graph comparing the prior art construction with the present invention by plotting air velocity versus pressure drop across the air side of the condenser.

FIG. 8, in curve "M" thereon, illustrates the air side pressure drop for a conventional core for various air flows. Curve "N" illustrates the air side pressure drop for the core of the present invention. It will be appreciated that the air side pressure drop, and thus fan energy, is reduced when a core made according to the invention is utilized.

From the foregoing, it will be appreciated that a condenser made according to the invention utilizing all three facets thereof, i.e., small hydraulic diameter, at least one elongated crevice, and the presence of microcracks or channels unexpectedly achieves a considerable increase in efficiency. Needless to say, where maximum advantage of the invention in all three facets is not required, a single facet, or a combination of any two facets may be utilized as desired.

We claim:

1. A condenser comprising:

a pair of spaced headers arranged to have a vapor inlet and a condensate outlet;

a plurality of tubes extending in hydraulic parallel between said headers, each in fluid communication with each of said headers;

said tubes having a plurality of discrete hydraulically parallel capillary fluid flow paths between said headers;

each of said fluid flow paths being noncircular in cross section and having at least one elongated crevice extending along the length thereof;

the hydraulic diameter of each of said flow paths being sufficiently small that surface tension in condensate in said crevice will create an area of relatively lower pressure thus causing a pressure differential whereby condensate in a film elsewhere in said flow path will flow by operation of said pressure differential to said crevice;

said hydraulic diameter being in the range of about 0.015 to 0.040 inches, said hydraulic diameter being the cross-sectional area of the corresponding flow path multiplied by four and divided by the wetted perimeter of the corresponding flow path; and, said flow paths having surfaces subjected to vapor and condensate and including microcracks.

2. The condenser of claim 1 wherein said surfaces are coated with a ceramic material and said microcracks are located in said ceramic material.

3. The condenser of claim 2 wherein said ceramic material is a brazing flux residue.

4. A condenser comprising:

a pair of spaced headers including a vapor inlet and a condensate outlet;

a plurality of tubes extending in hydraulic parallel between said headers, each in fluid communication with each of said headers;

said tubes having a plurality of discrete, hydraulically parallel fluid flow paths between said headers, each said flow path having a noncircular, nominally triangular cross section to define a plurality of crevices for each such flow path;

said tubes being flattened tubes;

each of said fluid flow paths having a hydraulic diameter in the range of 0.015 inches to 0.040 inches, said hydraulic diameter being the cross-sectional area of the corresponding flow path multiplied by four and divided by the wetted perimeter of the corresponding flow path;

said fluid flow paths being defined by a spacer within each of said tubes and brazed thereto; and, said spacers and/or said tubes having a coating of residual brazing flux defining microcracks.

5. A condenser comprising:

a pair of spaced headers including a vapor inlet and a condensate outlet;

a plurality of tubes extending in hydraulic parallel between said headers, each in fluid communication with each of said headers;

said tubes having a plurality of discrete, hydraulically parallel fluid flow paths between said headers, each said flow path having a noncircular, nominally triangular cross section to define a plurality of crevices for each such flow path;

each of said fluid flow paths having a hydraulic diameter in the range of 0.015 to 0.040 inches, said hydraulic diameter being the cross-sectional area of the corresponding flow path multiplied by four and divided by the wetted perimeter of the corresponding flow path;

each of said fluid flow paths having a surface provided with microcracks.

6. A condenser comprising:

a pair of spaced headers;

one of said headers having a vapor inlet;

one said headers having a condensate outlet; and a plurality of tubes extending in hydraulic parallel between said headers, each in fluid communication with each of said headers;

said tubes having a plurality of discrete hydraulically parallel fluid flow paths between said headers;

each of said fluid flow paths having at least one elongated crevice and an internal surface provided with microcracks, each of said fluid flow paths further having a sufficiently small hydraulic diameter so that surface tension and capillary forces acting upon condensate within said flow paths improve heat transfer efficiency of said condenser, said hydraulic diameter being the cross-sectional area of the corresponding flow path multiplied by four and divided by the wetted perimeter of the corresponding flow path.

7. The condenser of claim 6 wherein said tubes are flattened tubes and each includes an undulating spacer therein to define said plurality of said flow paths within each of said tubes.

8. The condenser of claim 6 wherein said hydraulic diameter is sufficiently small so as to be capable of complete filling by condensed refrigerant by capillary forces whereby the condenser may operate independently of gravity.

9. A condenser for a refrigerant in a cooling system comprising:

a pair of spaced, generally parallel, elongated cylindrical tubes defining headers;

a vapor inlet in one of said tubes;

a condensate outlet from one of said tubes;

said header tubes each having a series of elongated generally parallel slots with the slots in the series on one header tube aligned with and facing the slots in the series on the other header tube;

a tube row defined by a plurality of straight, tubes of flat cross-section and with flat side walls and having opposed ends extending in parallel between said header tubes, the ends of said flat cross section tubes being disposed in corresponding aligned ones of said slots and in fluid communication with the interiors of said header tubes, at least some of said tubes being in hydraulic parallel with each other;

web means within said flat cross-section tubes and extending between and joined to the flat side walls at spaced intervals to (a) define a plurality of discrete, hydraulically parallel flow paths within each flat cross-section tube that extend between said header tubes; to (b) absorb forces resulting from internal pressure within said condenser and tending to expand the flat cross-section tubes; and to (c) conduct heat between both said flat sides and fluid in said flow paths, said flow paths being of relatively small hydraulic diameter which is defined as the cross-sectional area of the corresponding flow path multiplied by four (4) and divided by the wetted perimeter of the corresponding flow path;

serpentine fins incapable of supporting said flat cross-section tubes against substantial internal pressure extending between facing flat side walls of adjacent flat cross-section tubes;

each of said flow paths including at least one elongated crevice extending generally along the length of the associated flow path.

10. The condenser of claim 9 wherein each flow path has a plurality of said crevices.

* * * * *

UNITED STATES PATENT AND TRADEMARK OFFICE

CERTIFICATE OF CORRECTION

PATENT NO. : 4,998,580
DATED : March 12, 1991
INVENTOR(S) : GUNTLY, ET AL.

It is certified that error appears in the above-identified patent and that said Letters Patent is hereby corrected as shown below:

Title Page, after "Inventors:", change "Leon A. Guntly, Norman F. Costello, both of Racine, Wis." to --Leon A. Guntly of Racine, Wis.; Norman F. Costello of Farmington Hills, Mich.; Jack C. Dudley of Racine, Wis.; and Russell C. Awe of Brookfield, Wis.--

Column 1, line 33, change "are" to --area--.

Column 9, line 23, change "Ratio outside surface" to inside surface $$\text{--Ratio } \frac{\text{outside surface}}{\text{inside surface}}\text{--}$$

Claim 5, line 13 (Column 10, line 58), between "of" and 0.015, insert --about--.

Signed and Sealed this

Twenty-first Day of July, 1992

*Attest:*

DOUGLAS B. COMER

*Attesting Officer*

*Acting Commissioner of Patents and Trademarks*